US007258153B2

(12) United States Patent
Chen

(10) Patent No.: US 7,258,153 B2
(45) Date of Patent: Aug. 21, 2007

(54) AUTO-REVERSIBLE FOLDING DOOR

(76) Inventor: Chin-Fu Chen, Room B, 25F., No. 51, Sec. 2, Gongyi Rd., Nantun District, Taichung City (TW)

( * ) Notice: Subject to any disclaimer, the term of this patent is extended or adjusted under 35 U.S.C. 154(b) by 346 days.

(21) Appl. No.: 11/067,918

(22) Filed: Mar. 1, 2005

(65) Prior Publication Data

US 2006/0196616 A1 Sep. 7, 2006

(51) Int. Cl.
*E05D 15/26* (2006.01)

(52) U.S. Cl. ..... 160/206; 16/76

(58) Field of Classification Search ..... 160/199, 160/206, 209, 207, 213, 196.1; 16/63, 64, 16/65, 78, 72, 75, 76, 77, 85
See application file for complete search history.

(56) References Cited

U.S. PATENT DOCUMENTS 1,626,764 A * 5/1927 Thorne ..... 160/199
3,389,741 A * 6/1968 Bean ..... 160/199
3,437,125 A * 4/1969 Hargrove ..... 160/193
5,109,911 A * 5/1992 Bockisch ..... 160/199
5,186,230 A * 2/1993 Ostrander ..... 160/206

* cited by examiner

*Primary Examiner*—David Purol
(74) *Attorney, Agent, or Firm*—Birch, Stewart, Kolasch & Birch, LLP

(57) ABSTRACT

An auto-reversible folding door includes a sliding rail, a first door panel and a second door panel. The first door panel and the second door panel are pivotally connected, the top of the outer flange of the first door panel is pivotally coupled within the sliding rail, a clamping device located inside a sliding rail can clamp an inserting clasp of the guide pulley at the upper portion of the second door panel, a swivel spring having a first end attached to the sliding rail, a second end linked to the guide pulley of the second door panel. When pulling the second door panel toward the first door panel, the inserting clasp and the clamping device are positioned by the interlock relationship. When pressing the second door panel, the clamping device will release the inserting clasp and the second door panel is pulled back to its original position.

4 Claims, 8 Drawing Sheets

AUTO-REVERSIBLE FOLDING DOOR

FIELD OF THE INVENTION

The present invention relates to a sliding door that can be folded and more particularly, to an auto-reversible folding door which can be closed automatically by an elastic restoring force.

BACKGROUND OF THE INVENTION

In the daily life, folding sliding doors are installed in quite many places, for example, in wardrobes, storage trunk, shoes cabinet and so on. It is mainly because the structure of such sliding doors is simple, the weight of the door is light and it is less space occupational when the door is opened and closed. Please refer to FIGS. 1 and 2, which show the structure of a conventional sliding door, it is mainly comprised of a track 1, a first door panel 2 and a second door panel 3 which are both equipped underneath the track 1. The first door panel 2 is adjacently hinged to the second door panel 3. The top of the outer flank of the first door panel 2 is pivotally linked to the track 1. A pulley 4 is located at the top of the outer flank of the second door panel 3, such pulley 4 can be rolled along the track 1 towards the direction of the first door panel 2. Users may push the second door panel 3 towards the first door panel 2, the pivotal portion between the first door panel 2 and the second door panel 3 is then folded causing the second door panel 3 to lean against the first door panel 2, thus the first door panel 2 and the second door panel 3 will form a superposition at one side to allow the door opened. When closing the door, users have to pull the second door panel 3 back to its original position, so that the first door panel 2 and the second door panel 3 can be horizontally adjacent to each other. It is not ideal for users to always have to manually push the second door panel 3 to open the door and to pull back the second door panel 3 when closing. And users will eventually forget to pull back the second door panel 3 to its original position, causing the chance of door closure is not frequent even the folding sliding door is installed, gradually formed nominally.

SUMMARY OF THE INVENTION

It is a primary object of the present invention to provide an auto-reversible folding door including a sliding rail, a first door panel and a second door panel both located below the sliding rail, the neighboring portion of the first door panel and the second door panel is pivotally connected, the top of the outer flange of the first door panel is pivotally coupled within the sliding rail, a clamping device located inside the sliding rail can clamp a inserting clasp of the guide pulley at the upper portion of the second door panel, a swivel spring having a first end attached to the sliding rail, a second end linked to the guide pulley of the second door panel. When the user pulls the second door panel toward the first door panel, the second door panel can be positioned by the interlock relationship between the inserting clasp and the clamping device. When the user presses the second door panel again, the clamping device will release the inserting clasp and the second door panel is then pulled back to its original position to form a close state through an elastic restoring force.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
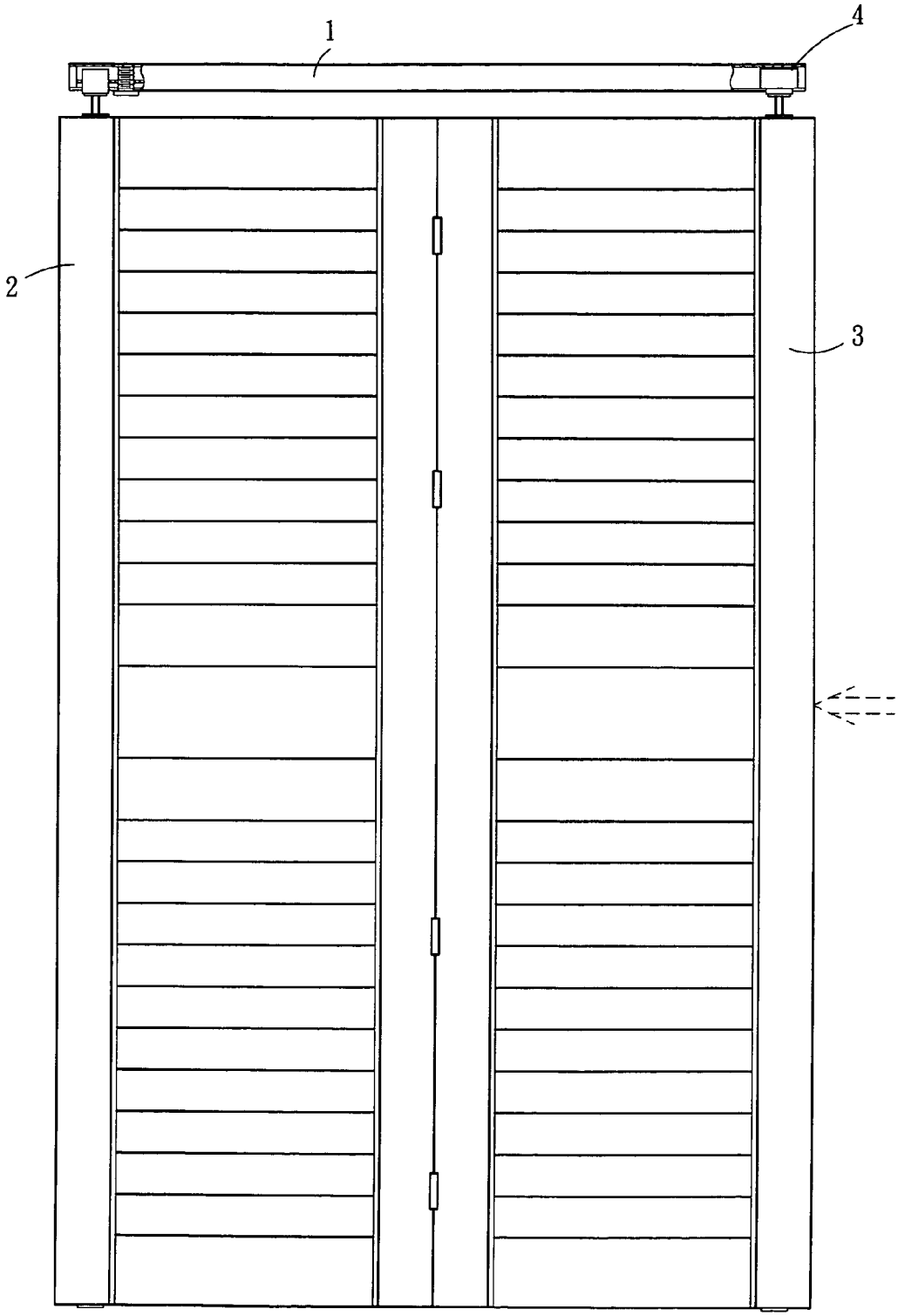
Fig . 1 PRIOR ART
FIG. 1 is a front view of the conventional folding sliding door.
Figure 2:
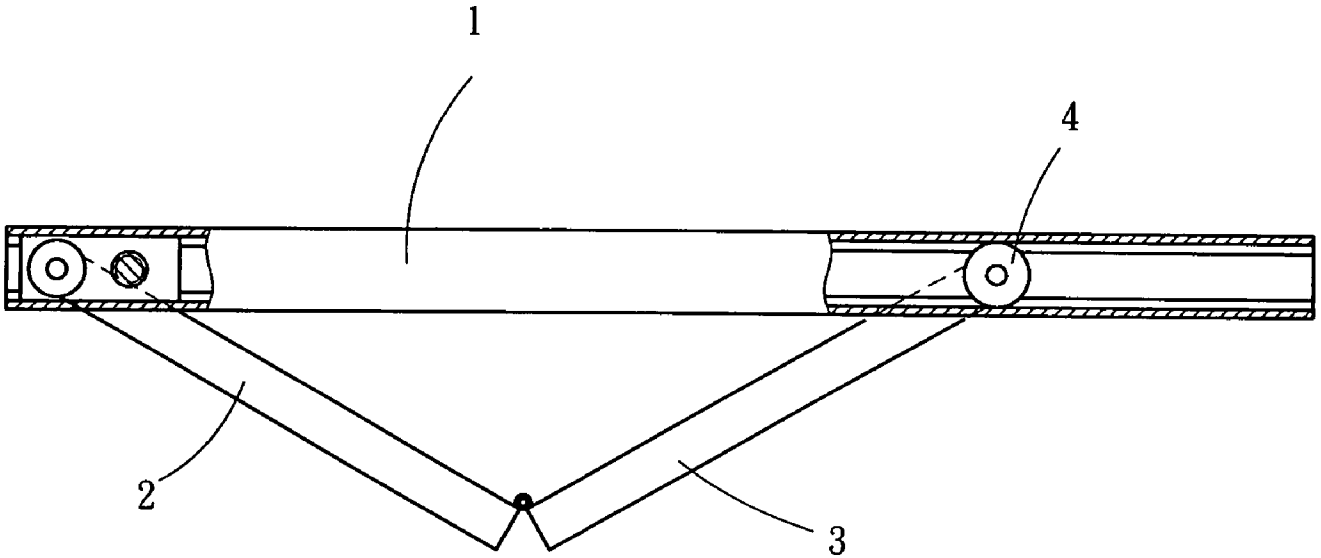
Fig. 2 PRIOR ART
FIG. 2 is a top view of the conventional folding sliding door.
Figure 3:
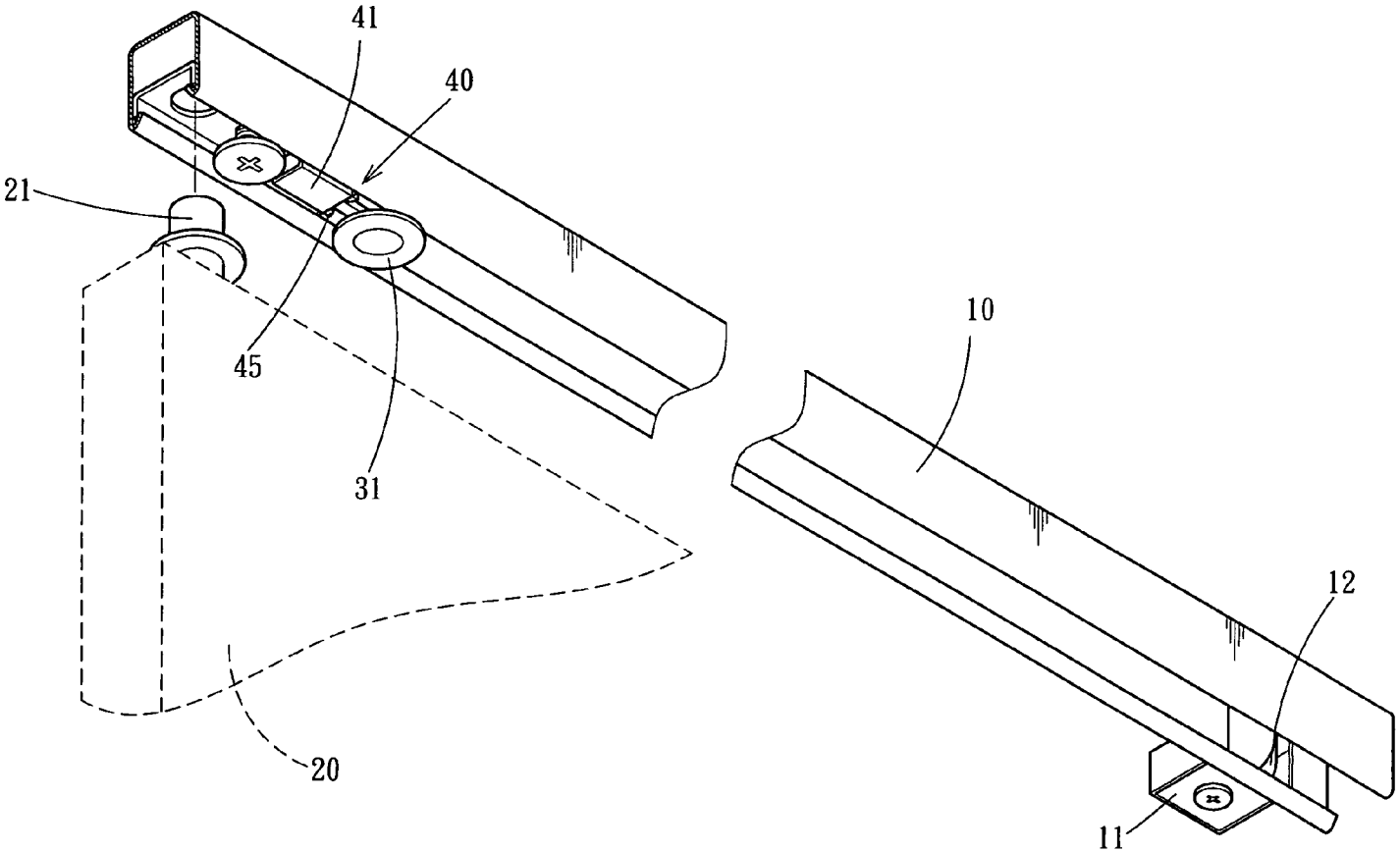
FIG. 3 is a perspective view of the preferred embodiment of the present invention after assembly.
Figure 4:
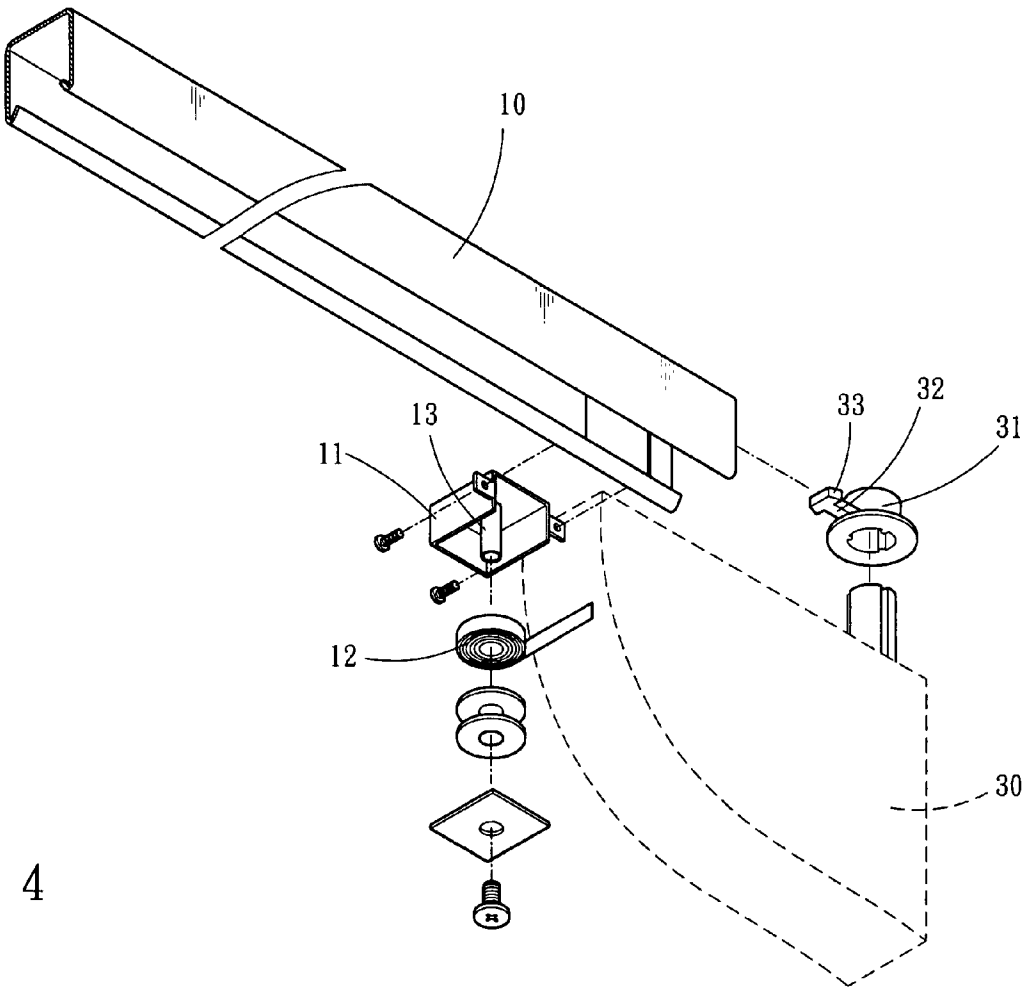
FIG. 4 is an exploded view of the preferred embodiment of the present invention illustrating the swivel spring and the guide pulley of the second door panel.

Please refer to FIGS. 3 and 4, show the auto-reversible folding door of the present invention, including a sliding rail 10 which appropriately consists of a U-shaped rail whose legs are angled inwards at their ends, the sliding rail 10 is fixedly located at the upper flange of a cabinet. The front part of one side of the sliding rail 10 consists of a casing 11 having an opening. A swivel spring 12 is arranged within the casing 11. A first end of the swivel spring 12 is attached to a shaft 13 that is located at the center of the casing 11, the swivel spring 12 is coiled on the shaft 13. A second end of the swivel spring 12 is extended out of the casing 11 through the opening and stretched towards the interior of the sliding rail 10.

A first door panel 20 and a second door panel 30 are horizontally adjacent to each other, both located below the sliding rail 10. The neighboring portion of the first door panel 20 and the second door panel 30 is pivotally connected, so that the second door panel 30 can be folded towards the first door panel 20 to form a superposition. The top of the outer flange of the first door panel 20 having a shaft 21 which is pivotally coupled within the sliding rail 10 allowing the shaft 21 to rotate. Please refer to FIGS. 5 and 6A, which show a clamping device 40 that is located at the inner side of the shaft 21 and is fixedly engaged within a compartment 41 of the sliding rail 10. A hollow clamping member 42 having an opening at one side is inserted into the compartment 41. The top of the clamping member 42 having a wave-shaped positioning groove 43 while the bottom longitudinally located a guide slot 44. A clamp 45 having its rear part inserted into the interior of the clamping member 42. An elastic member 46, which can be axially expanded and contracted, is located between the clamping member 42 and the clamp 45. The upper portion of the clamp 45 protrudes with a movable positioning rod 47 which can be inserted into the positioning groove 43, and the positioning rod 47 is hidden in the position groove 43. The bottom portion of the clamp 45 protrudes with an inserting rod 48, such inserting rod 48 can be inserted into the guide slot 44 of the clamping member 42. The inserting rod 48 can also shift along the guide slot 44, so that the clamp 45 can insert into the clamping member 42 when the clamp 45 is being pushed. Through the positioning rod 47 engaged within one side of the positioning groove 43, the clamp 45 can be inserted within the clamping member 42 and positioned.

And the top of the outer flange of the second door panel 30 is pivoted to a guide pulley 31. The outer portion of the guide pulley 31 is fixedly linked to the second end of the swivel spring 12. The front part of the guide pulley 31 protrudes with an inserting clasp 32. A hook 33 is located at the front end of the inserting clasp 32. Such hook 33 can be inserted into the clamp 45 of the clamping device 40 when the hook 33 is driven by and moved along with the guide pulley 31 of the second door panel 30.

Figure 6A:
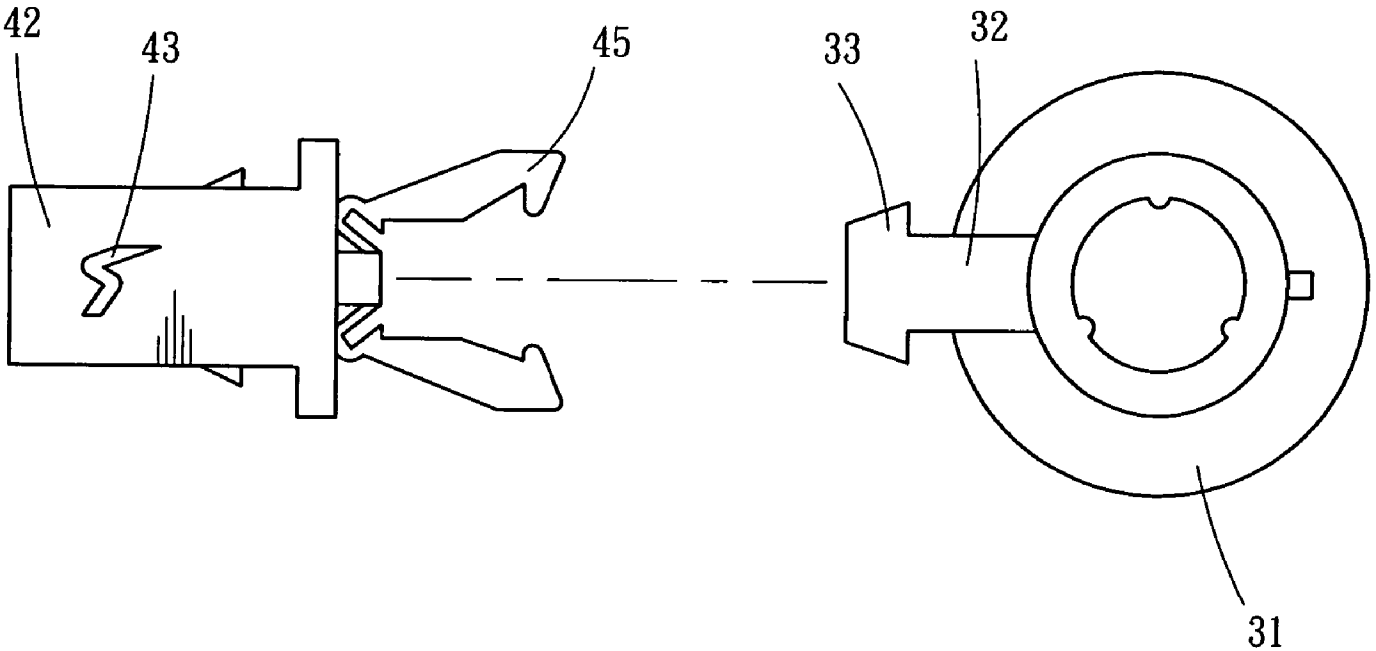
FIG. 6A is a perspective view of the clamping device in motion.
Figure 6B:
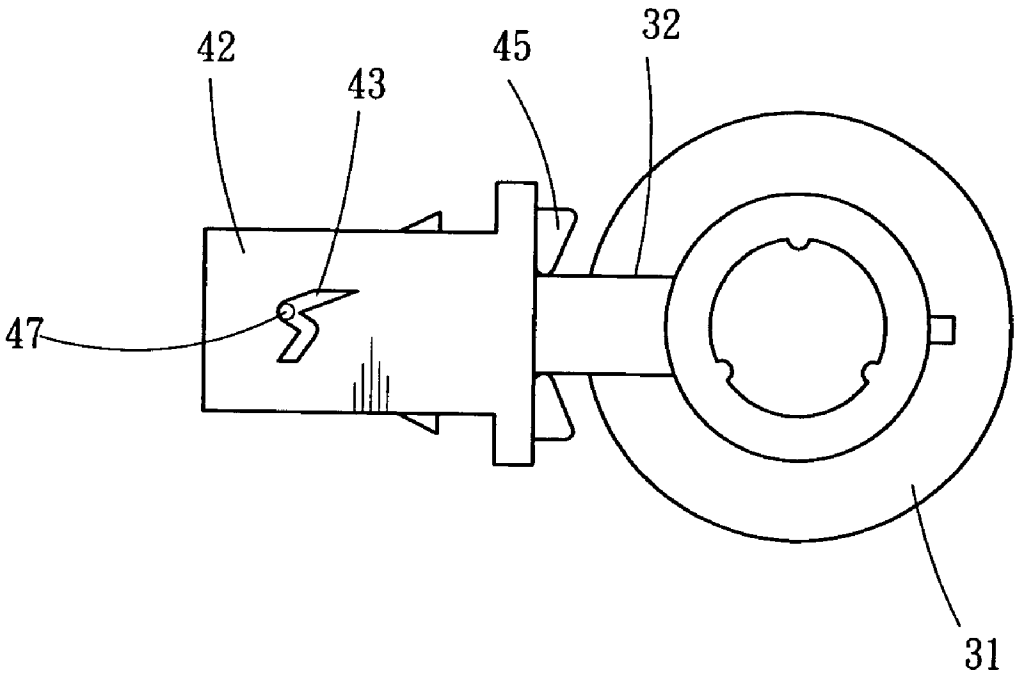
FIG. 6B is a perspective view of the clamping device in another motion.
Figure 7:
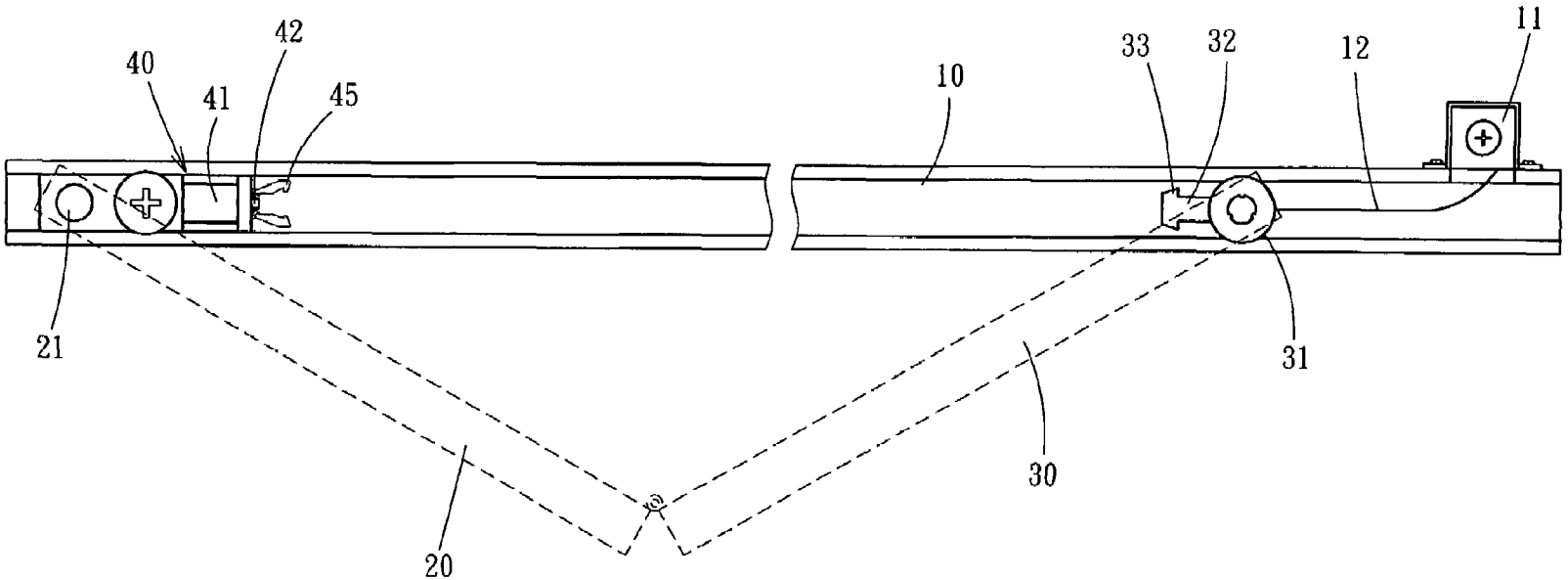
FIG. 7 is a top view of the preferred embodiment of the present invention.

According to the above structure, please refer to FIG. 7 together with FIGS. 6A and 6B, when the user pushes the second door panel 30 towards the first door panel 20, the pivotal portion between the first door panel 20 and the second door panel 30 is then folded causing the second door panel 30 to lean against the first door panel 20, thus the first door panel 2 and the second door panel 3 will form a superposition at one side to allow the door opened. At the same time, the guide pulley 31 at the upper portion of the second door panel 30 can slide towards the clamping device 40, allowing the inserting clasp 32 to press against the clamp 45, thus causing the rear portion of the clamp 45 to be inserted into the clamping member 42. The clamp 45 is then inserted into the opening of the clamping member 42 in order to interlock the inserting clasp 32 of the second door panel 30. The second door panel 30 is then being positioned. Since the guide pulley 31 is fixedly linked to the second end of the swivel spring 12, so that the guide pulley 31 will also pull the swivel spring 12 to form a stretch state.

Figure 5:
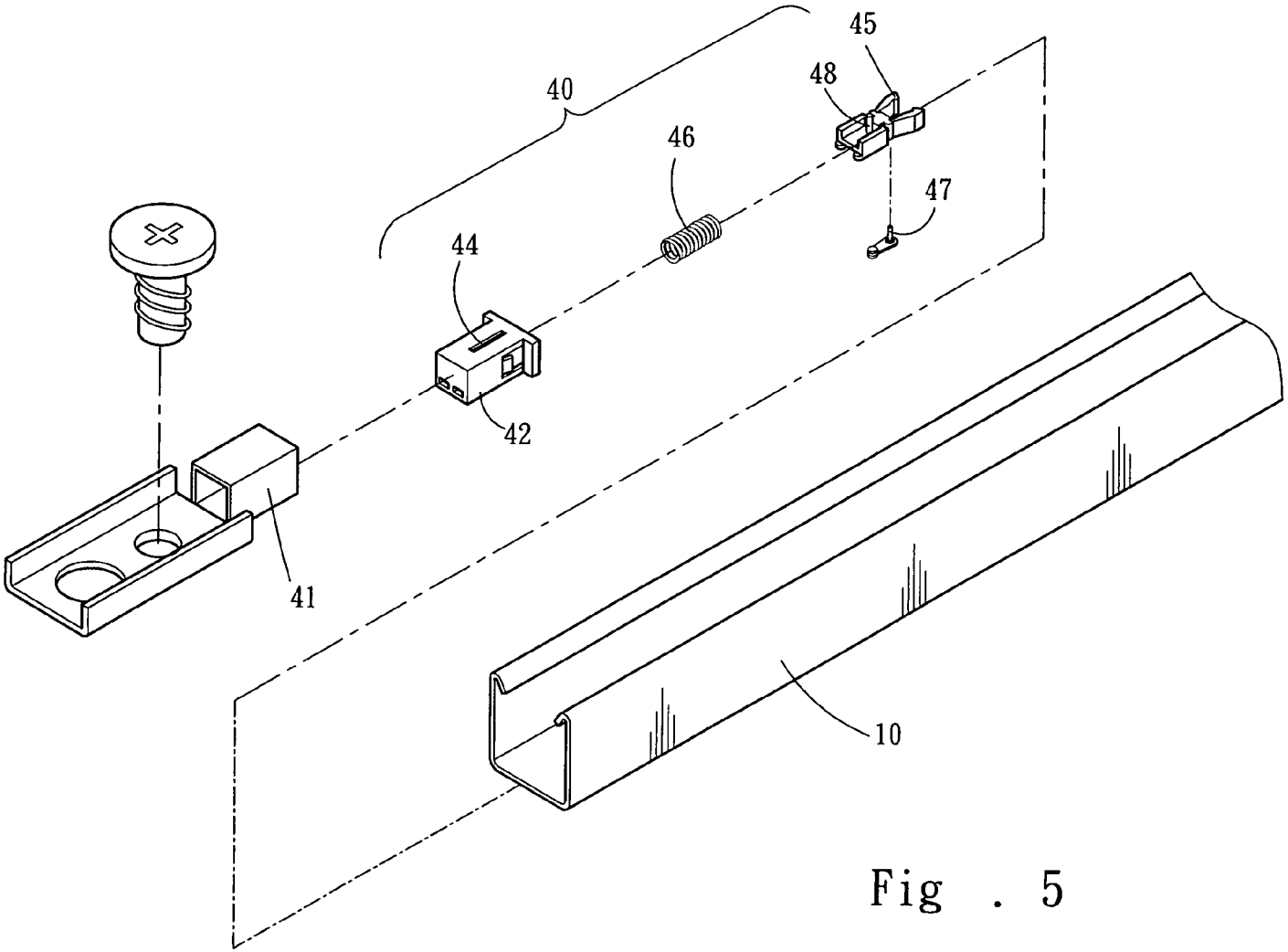
FIG. 5 is another exploded view of the present invention illustrating the clamping device.

If users want to pull back the second door panel 30 to a close state, the user can manually press the outer portion of second door panel 30 towards the first door panel 20 again, so that the inserting clasp 32 of the guide pulley 31 will exert pressure again on the clamp 45 allowing the inserting clasp 32 to go further inwards. Thus, the positioning rod 47 at the top portion of the clamp 45 will shift back to its original position along with the wave-shaped positioning groove 43 of the clamping member 42, the elastic body 46 (as shown in FIG. 5) will push out the clamp 45 towards the opening. The clamp 45 will then release the inserting clasp 32, allowing the guide pulley 31 of the second door panel 30 to be pulled back to the edge of the sliding rail 10 through the elastic restoring force of the swivel spring 12. The door is then closed.

In summary, the present invention has been manufactured to be samples according to the content of the specification and the drawings, and it is proved to achieve the anticipated goal and effect due to numbers of successful experimental operation. The present invention is proved to be auto-reversible and close the door automatically. When the user pulls the second door panel 30 towards the first door panel 20, the first door panel 2 and the second door panel 3 will form a superposition at one side of the sliding rail 10 to allow the door opened. When the user presses the second door panel 30 again, the clamping device 40 will release the inserting clasp 32 of the second door panel 30, and through the elastic restoring force of the swivel spring 12 at the end of the sliding rail 10, the second door panel 30 is then pulled back to its original position to form a close state.

Although the invention has been explained in relation to its preferred embodiment, it is not used to limit the invention. It is to be understood that many other possible modifications and variations can be made by those skilled in the art without departing from the spirit and scope of the invention as hereinafter claimed.

What is claimed is:

1. An auto-reversible folding door, comprising:

a sliding rail;

a first door panel and a second door panel both located below the sliding rail, the neighboring portion of the first door panel and the second door panel is pivotally connected, the top of the outer flange of the first door panel having a shaft which is pivotally coupled within the sliding rail;

a clamping device located at the inner side of the shaft;

a guide pulley located at the top of the outer flange of the second door panel, the guide pulley can shift along with the sliding rail towards the first door panel;

a swivel spring installed in a casing and the casing located at the front side of one end of the sliding rail, a shaft installed in the casing to attach and coil a first end of the swivel spring, and a second end of the swivel spring is extended out of the casing through the opening and stretched towards the interior of the sliding rail;

an inserting clasp formed outside the guide pulley, wherein the inserting clasp can clamp into the clamping device comprising a hollow clamping member having an opening, the top of the clamping member having a wave-shaped positioning groove while the bottom located a guide slot, the opening inserted with a clamp; and an elastic body is located between the clamping member and the rear portion of the clamp, the upper portion of the clamp having a positioning rod that can be inserted into the positioning groove of the clamping member, the bottom portion of the clamp having an inserting rod that can be inserted into the guide slot of the clamping member, so that the clamp can elastically stretch to capture and release the inserting clasp.

2. The auto-reversible folding door according to claim 1, wherein the clamping device is installed in a compartment and the compartment is fixedly engaged within the sliding rail.

3. The auto-reversible folding door according to claim 1, wherein the front end of the inserting clasp of the guide pulley further includes a hook which can be inserted into the clamp of the clamping device.

4. The auto-reversible folding door according to claim 1, wherein the sliding rail consists of a U-shaped rail.

* * * * *